US007216829B2

(12) United States Patent
Gallwitz et al.

(10) Patent No.: US 7,216,829 B2
(45) Date of Patent: May 15, 2007

(54) DEVICE FOR CONTROLLING THE BEARING PRESSURE OF A TEXTILE BOBBIN ON A SUPPORT ROLLER OR DRIVE ROLLER

(75) Inventors: Claudia Gallwitz, Mönchengladbach (DE); Ralf Siewert, Schwalmtal (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/966,864

(22) Filed: Oct. 15, 2004

(65) Prior Publication Data

US 2005/0082417 A1 Apr. 21, 2005

(30) Foreign Application Priority Data

Oct. 16, 2003 (DE) ..... 103 48 707

(51) Int. Cl.
*B65H 54/52* (2006.01)

(52) U.S. Cl. ..... 242/486.4

(58) Field of Classification Search ..... 242/486.4, 242/485.9, 541.5, 541.4, 486.1, 422.5, 547
See application file for complete search history.

(56) References Cited

U.S. PATENT DOCUMENTS

| | | | | |
|---|---|---|---|---|
| 2,150,951 A | | 3/1939 | Toole et al. | 242/18 |
| 2,594,509 A | | 4/1952 | Stahl | 242/18 |
| 3,991,950 A | * | 11/1976 | Tashiro et al. | 242/486.4 |
| 4,102,506 A | * | 7/1978 | Raasch et al. | 242/486.4 |
| 4,120,462 A | * | 10/1978 | Raasch et al. | 242/413.6 |
| 5,163,631 A | * | 11/1992 | Borer | 242/486.4 |
| 5,697,565 A | * | 12/1997 | Zitzen | 242/486.4 |
| 6,170,777 B1 | * | 1/2001 | Dorfel et al. | 242/541.5 |
| 6,254,028 B1 | * | 7/2001 | Burchert | 242/486.2 |

FOREIGN PATENT DOCUMENTS

| | | |
|---|---|---|
| DE | 15 60 435 B | 1/1970 |
| DE | 1 685 676 | 8/1971 |
| DE | 1685676 A1 * | 8/1971 |

(Continued)

OTHER PUBLICATIONS

Translation of Reference N, JP 03079562 A, cited above.*

(Continued)

*Primary Examiner*—Patrick Mackey
*Assistant Examiner*—William E. Dondero
(74) *Attorney, Agent, or Firm*—Kennedy Covington Lobdell & Hickman, LLP

(57) ABSTRACT

An apparatus for holding a textile bobbin on a support roller and for facilitating the exertion of a controlled bearing pressure from the textile bobbin against the support roller. The apparatus comprising a creel for grasping the textile bobbin, a shaft for supporting the creel for pivotable movement relative to the support roller, a lever mechanism for applying a variable torque to the creel as a function of pivoted movement of the lever mechanism, and an adjustment device for varying the torque applied to the creel via the lever mechanism. The adjustment device comprises a rotatable eccentric element disposed to act on the lever mechanism for establishing an adjustable base position of the lever mechanism according to a rotated position of the eccentric element.

5 Claims, 3 Drawing Sheets

FOREIGN PATENT DOCUMENTS

| | | | |
|---|---|---|---|
| DE | 1685676 | A1 * | 8/1971 |
| DE | 22 20 727 | A | 11/1973 |
| DE | 2 406 122 | | 8/1974 |
| DE | 25 18 646 | A | 4/1975 |
| DE | 32 40 484 | A1 | 6/1983 |
| JP | 03-0 79 562 | A | 4/1991 |
| JP | 03079562 | A * | 4/1991 |

OTHER PUBLICATIONS

Translation of Reference O, DE 1685676 A1, cited above.*
European Search Report.

* cited by examiner

DEVICE FOR CONTROLLING THE BEARING PRESSURE OF A TEXTILE BOBBIN ON A SUPPORT ROLLER OR DRIVE ROLLER

CROSS-REFERENCES TO RELATED APPLICATIONS

This application claims the benefit of German patent application 10348707.7 filed Oct. 16, 2003, herein incorporated by reference.

FIELD OF THE INVENTION

The present invention relates to a device for controlling the bearing pressure of a textile bobbin on a support roller or drive roller.

BACKGROUND OF THE INVENTION

Devices for controlling the bearing pressure of a textile bobbin are known in various embodiments. Such a device performs substantially two tasks: first, adjusting the bearing pressure of the cheese on a support roller or drive roller and second, compensating the weight of said roller, which increases as the cheese becomes larger. Since the bearing pressure, in addition to the yarn tension, determines the density of the cheese, the goal is to keep the bearing pressure approximately constant during the entire bobbin travel.

In an embodiment disclosed in German Patent Publication DE 25 18 646C2, the cheese is arranged above a drive roller, and the creel is designed in such a manner that its center of gravity acts in the direction of the drive roller. The bearing pressure is amplified at the start of the bobbin travel by a combined loading and pressure-relieving element, preferably by a pressure spring that attaches to a lever attachment and is supported on an adjustment angle guide. That is, at the start of the bobbin travel the active line of the pressure spring is at first behind the creel shaft and exerts a counterclockwise torque that results in an additional bearing pressure of the creel on the drive roller. As the bobbin diameter increases, the creel pivots into a position in which the active line of the pressure spring is at first located at the same height as the creel axis. In this position, the bearing pressure of the cheese and the spring power of the loading and pressure-relieving element neutralize one another. As the diameter increases further, the active line of the pressure spring moves in front of the creel shaft. That is, pressure is now removed from the creel by the torque acting in a counterclockwise direction.

The described creel-loading and pressure-relieving device has proven itself in practice in a somewhat modified embodiment and is widely used. However, this device has the disadvantage that the adjusting of the bearing pressure of the individual winding heads takes place centrally via an adjustment rail equipped with wedges that pivot the adjustment angle guides arranged in the area of the winding heads for the pressure springs. It is particularly disadvantageous in open-end rotor spinning machines, where temperature variations cause the adjustment rail to lengthen or contract. As a result thereof, the draw keys or spring-coupling keys used for adjustment are positioned differently at the beginning and at the end of the rail, which results in a differing bearing pressure of the cheeses on the drive roller.

SUMMARY OF THE INVENTION

It is believed that there is a need for a device for controlling the bearing pressure of a textile bobbin that is simple to handle and is substantially uninfluenced by temperature changes. It is among the general objectives of the invention to satisfy these needs.

Briefly summarized the present invention addresses these objectives by providing an apparatus that holds a textile bobbin and controls the pressure that the bobbin exerts on a support roller by utilizing a lever mechanism and an adjustment device comprising an eccentric element supported on an eccentric shaft. More particularly, the apparatus preferably holds a textile bobbin in peripheral surface contact on a support roller with a controlled bearing pressure there against and comprises a creel for grasping the textile bobbin, a shaft for supporting the creel for pivotable movement relative to the support roller, a lever mechanism for applying a variable torque to the creel as a function of pivoted movement of the lever mechanism, and an adjustment device for varying the torque applied to the creel via the lever mechanism. The adjustment device comprises a rotatable eccentric element disposed to act on the lever mechanism for establishing an adjustable base position of the lever mechanism according to a rotated position of the eccentric element.

In a preferred embodiment, the apparatus is in combination with a textile machine having a plurality of winding heads each having one of the bobbin holding devices. The eccentric element of each of the apparatus is supported on an eccentric shaft extending along the plurality of winding heads. Preferably, the adjustment device of the apparatus further comprises a regulator wheel having a graduated scale for adjusting the rotated position of the eccentric element. In a further preferred embodiment, the apparatus is used in combination with an open-end rotor spinning machine.

Adjusting the bearing pressure for a plurality of winding devices by a common eccentric shaft is simple and easily possible. Advantageously, a longitudinal expansion of the eccentric shaft, as may be caused by temperature variations, does not influence the base position of the lever mechanism of the present invention. One need merely assure that the eccentric element remains engaged with the lever of the lever mechanism that determines the base position of the lever mechanism for the apparatus to function properly.

Additionally, since adjusting takes place via an angular position of the eccentric shaft, no increased space requirement for longitudinal shifting is required. For this reason, in a multi-head textile machine, adjusting may be performed between section boundaries of the machine. This additionally assures that bearing pressures that differ section by section can be adjusted separately, which is advantageous for multi-batch coverage. Further, the adjustment expense of the present invention is distinctly less in comparison to an individual adjusting of the winding apparatuses. In addition, the bearing pressure may be adjusted in advance by utilizing a regulator wheel with a graduated scaling. This adjusting can take place either continuously or in steps, for example, by means of a notched disk. In principle, mechanically adjusting the bearing pressure is advantageous over pneumatic pressure adjusting systems because of pressure losses that occur over long pressure lines in pneumatic systems causing bearing pressure deviation.

BRIEF DESCRIPTION OF THE DRAWINGS

The invention is explained in detail and will be more fully understood from the detailed description and the accompanying drawings, wherein.

DETAILED DESCRIPTION OF PREFERRED EMBODIMENTS

The following description of the preferred embodiment(s) is merely exemplary in nature and is in no way intended to limit the invention, its application, or uses.

Figure 1:
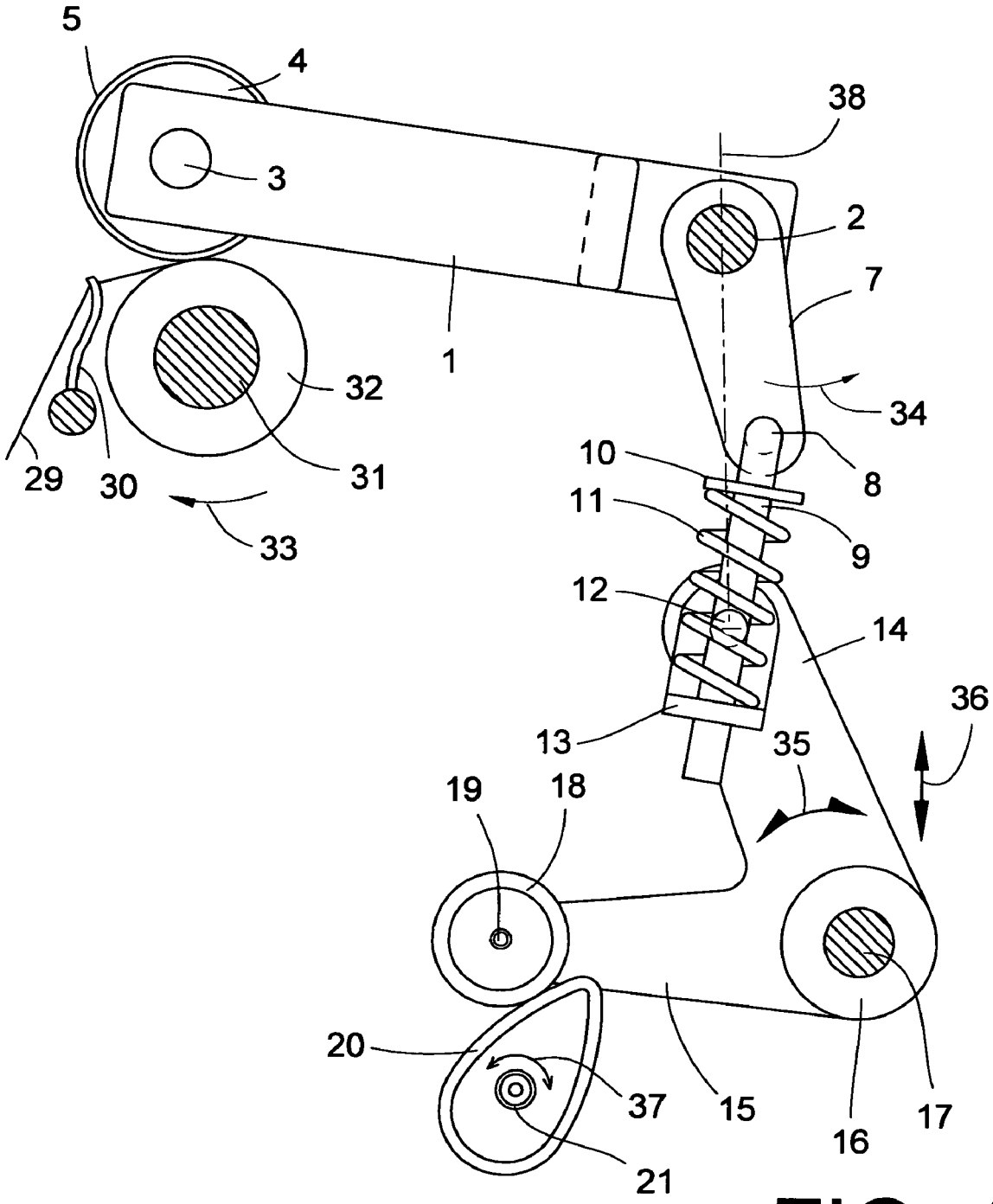
FIG. 1 is a side view of the creel-loading and pressure-relieving device in accordance with the invention at the start of the bobbin travel.
Figure 2:
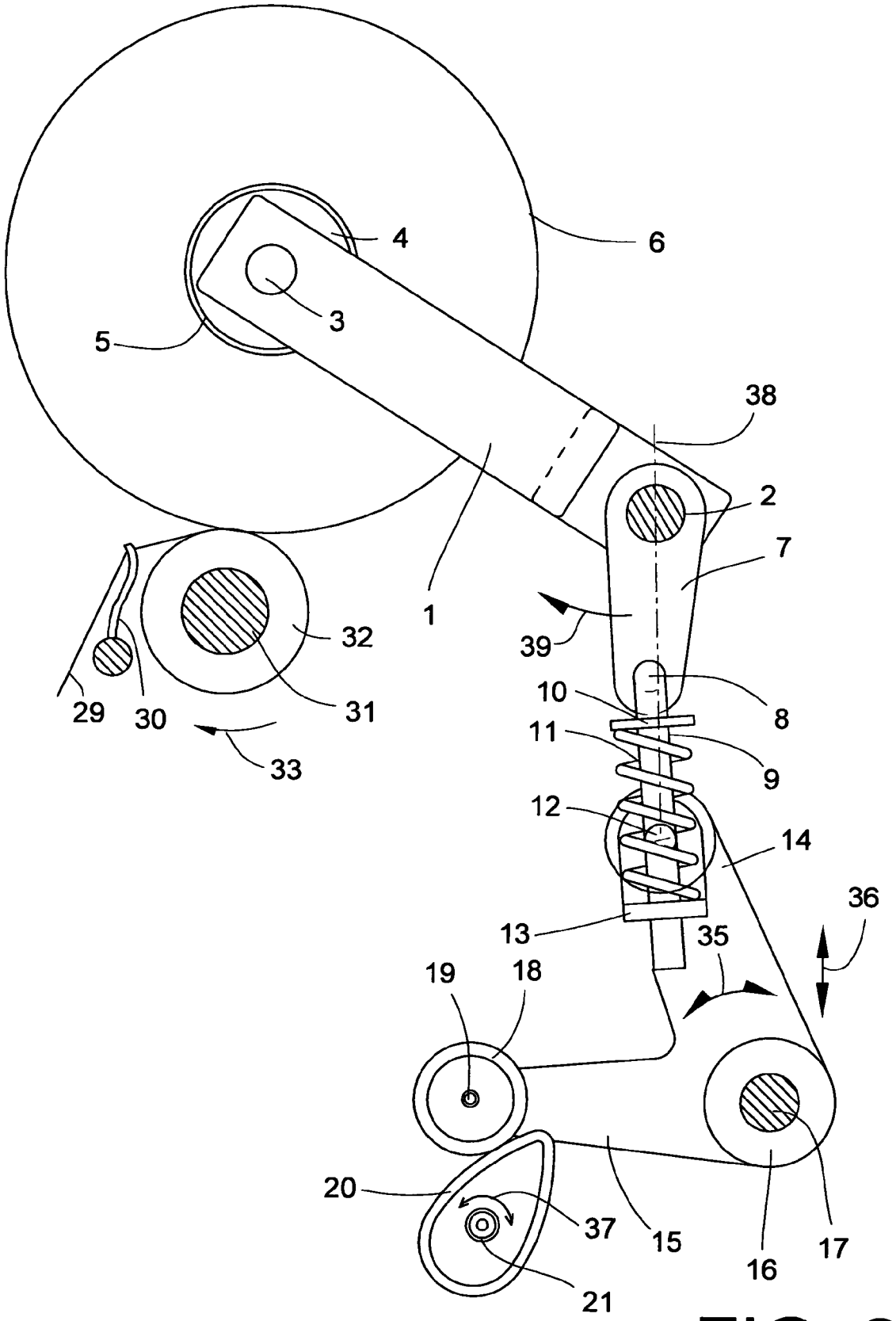
FIG. 2 is a side view of the creel-loading and pressure-relieving device in accordance with the invention at the end of the bobbin travel.

Referring now to the accompanying drawings, in which like numerals represent like components throughout the several views, and with initial references to FIGS. 1–2, the device of the present invention is shown at the start and the end of bobbin travel, respectively.

As shown in FIG. 1, a preferred embodiment of the apparatus comprises a creel 1 in which a bobbin tube 5 is held over a bobbin hub 4 that is mounted on a hub shaft 3. This bobbin tube 5 is frictionally driven by a drive roller 32. The drive roller 32 receives its drive from a drive shaft 31. In an embodiment wherein a textile machine having multiple winding heads is utilized, the drive shaft may extend throughout the entire machine.

If the drive roller 32 rotates in the direction indicated by arrow 33, a yarn 29 is wound in the shape shown in FIG. 2 onto the bobbin tube 5. During the winding, a yarn guide 30 causes the yarn 29 to traverse the bobbin hub 4 so that a cheese 6 (best shown in FIG. 2) is produced during the winding.

The creel 1 is supported on a creel shaft 2. A lever 7 is pivotally connected to the creel 1 via the creel shaft 2. Arrow 34 shows the pivotal movement of the lever 7. A rocker arm 9 is connected via a swivel joint 8 to the lever 7. The rocker arm 9 comprises pressure plates 10, 13 on which a pressure spring 11 is supported. Moreover, pressure plate 13 comprises a bent part connected via an ankle joint 12 to a first lever arm 14 of an angle lever 16.

It can be readily recognized that the pressure spring 11 is relieved to a greater or lesser degree as a function of the angular position of the first lever arm 14.

The angle lever 16 is stationarily supported by a stationary shaft 17 arranged in a machine frame (not shown here). Double arrow 35 indicates that this angle lever 16 can assume different angular positions, among other things, as a function of the position of the creel 1.

In addition, the angular position of the angle lever 16 influences an eccentric element 20. The eccentric element 20 is in contact with a roller 18 that is coupled by a roller shaft 19 to a second lever arm 15 of the angle lever 16. The eccentric element 20 is supported on an eccentric shaft 21 and may be rotated about the eccentric shaft 21, as is indicated by arrow 37. The rotation of the eccentric element 20 about the eccentric shaft 21 affects the position of the second lever arm 15, and consequently, the position of the angle lever 16. The position of the eccentric element 20 determines the base position of pressure plate 13 and thus the pressure force of the pressure spring 11 acting on the lever 7. The changing of the position of the pressure plate 13 is indicated by double arrow 36.

At the start of bobbin travel, as shown in FIG. 1, the acting direction of the pressure spring 11 is behind plane 38, which operates through the ankle joint 12 and the creel shaft 2. A counterclockwise torque is exerted on the lever 7 and thus on the creel 1, which is indicated by arrow 34. This results in a maximum contact pressure of the bobbin tube 5 on the drive roller 32.

As the bobbin hub 4 becomes more full, the creel 1 and the lever 7 pivot clockwise and reach an angular position at a certain point in time in which plane 38 operates not only through the ankle joint 12 and the creel shaft 2 but also through the center line of the rocker arm 9. In this position, the pressure spring 11 no longer exerts a torque on the creel 1, and therefore, the pressure force of the cheese 6 and the bobbin tube 5 on the drive roller 32 is neutralized.

In FIG. 2, the above-described point has been exceeded and thus, the pressure spring 11 begins to generate a clockwise moment via lever 7 that is indicated by arrow 39. This clockwise moment assists in supporting the cheese 6 and the creel 1 when the cheese weight achieved in the interim is so great that the pressure force generated by the cheese 6 on the support roller 32 would be detrimental to the cheese 6 quality.

Figure 3:
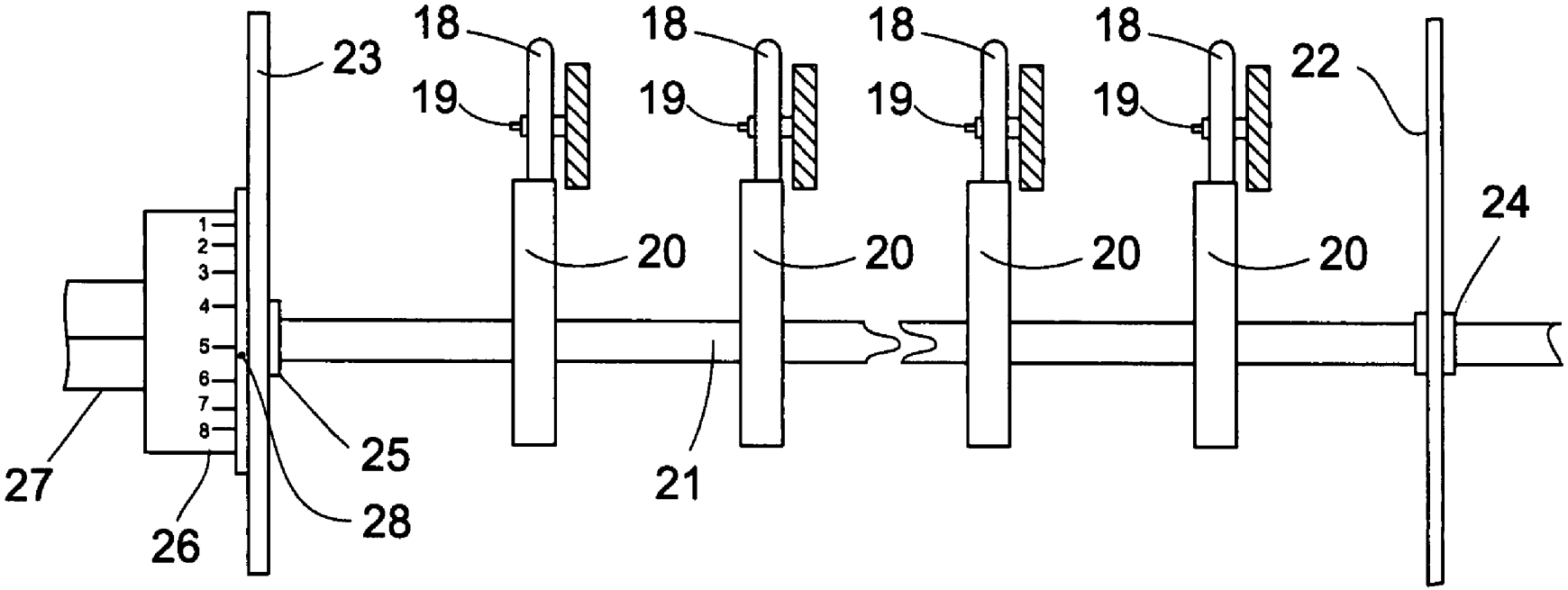
FIG. 3 is a front view, partially cutaway, of the device in accordance with the invention for a section-by-section adjusting of the bearing pressure.

If, for example, a cheese 6 with a changed density is manufactured, the relationship between the cheese diameter and the cheese weight is correspondingly influenced. As a consequence, the course of the loading and relieving of the creel 1, which is controlled solely by the cheese diameter, is no longer optimal. Accordingly, an adjustment of the bearing pressure control must be performed. As has been previously described, the base position of the angle lever 16 can be altered by the eccentric element 20. As shown in FIG. 3, the eccentric element 20 is supported on the eccentric shaft 21. This eccentric shaft 21 is supported in bearings 24, 25, which are fastened inside frame wheels 22, 23.

Frame wheel 23 is arranged at the end of a machine section or a machine unit. A regulator wheel 26 is supported on the eccentric shaft 21 adjacent to frame wheel 23 and has a graduated scale. A point on the scaling is brought into coincidence with indicated marking 28 to adjust the rotated position of the eccentric element 20 and thus determine the bearing pressure. Hexagonal element 27 is connected to the eccentric shaft 21 and may be used to adjust the eccentric shaft 21.

A gradual adjusting of bearing pressure may be achieved by using the regulator wheel 26 in combination with a notched disk (not shown). Alternatively, a continuous adjusting is also conceivable.

Just as a section-by-section arrangement of the eccentric shaft 21 is possible, it is also conceivable to allow this eccentric shaft to operate over several sections of a textile machine, as depicted in FIG. 3. Care must be taken, if necessary, and depending on the length of the eccentric shaft 21, that the overlap between the eccentric element 20 and the roller 18 is sufficiently great that a sufficient contact between the eccentric element 20 and the roller 18 exists even at maximum thermal expansion. As can be recognized in principle, a longitudinal extension of the eccentric shaft 21 has no influence on the position of the roller 18 or on the second lever arm 15, which is positioned by the eccentric element 20. Thus, thermal expansion will not influence the base position of the angle lever 16, and consequently, the bearing pressure of the creel 1 or of the bobbin tube 5 on the drive shaft 32.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended to be construed to limit the present invention or otherwise to exclude any such other embodiments, adaptations, variations, modifications and equivalent arrangements, the present invention being limited only by the claims appended hereto and the equivalents thereof.

What is claimed is:

1. An apparatus for holding a textile bobbin in peripheral surface contact on a support roller with a controlled bearing pressure there against, comprising:

a creel for grasping the textile bobbin, a shaft supporting the creel for pivotable movement relative to the support roller, a lever mechanism for applying a variable torque to the creel as a function of pivoted movement of the lever mechanism, and an adjustment device for selectively pre-setting a starting torque applied to the creel via the lever mechanism upon start-up of the apparatus, the adjustment device comprising an eccentric element rotatably positionable into a selectively fixed disposition to act on the lever mechanism for adjustably establishing a base position of the lever mechanism according to the selectively fixed disposition of the eccentric element at which the lever mechanism applies the starting torque to the creel.

2. The apparatus according to claim 1, in combination with a plurality of winding heads each having one of the bobbin holding devices, wherein the eccentric element is supported on an eccentric shaft extending along the plurality of winding heads.

3. The apparatus according to claim 1, wherein the adjustment device further comprises a regulator wheel having a graduated scale for adjusting the rotated position of the eccentric element.

4. The apparatus according to claim 1, in combination with an open-end rotor spinning machine.

5. The apparatus according to claim 1, wherein the lever mechanism and the adjustment device are cooperatively configured and arranged to decrease progressively the torque to the creel as the yarn is progressively wound onto the bobbin and to further establish, as a function of the base position of the lever mechanism, an intermediate neutral position of the lever mechanism and a corresponding zero torque to the creel at a predetermined wound size of the bobbin.

* * * * *